US007958735B2

(12) United States Patent
Ellis et al.

(10) Patent No.: US 7,958,735 B2
(45) Date of Patent: Jun. 14, 2011

(54) TURBINE STATIC STRUCTURE FOR REDUCED LEAKAGE AIR

(75) Inventors: Charlie Ellis, Stuart, FL (US); J. Page Strohl, Stuart, FL (US); Matt Thomas, Riviera Beach, FL (US)

(73) Assignee: Power Systems Manufacturing, LLC, Jupiter, FL (US)

( * ) Notice: Subject to any disclaimer, the term of this patent is extended or adjusted under 35 U.S.C. 154(b) by 1199 days.

(21) Appl. No.: 11/614,329

(22) Filed: Dec. 21, 2006

(65) Prior Publication Data

US 2008/0148737 A1 Jun. 26, 2008

(51) Int. Cl.
*F01D 9/04* (2006.01)

(52) U.S. Cl. ..... 60/805; 415/191

(58) Field of Classification Search ..... 60/805; 415/139, 191, 211.2
See application file for complete search history.

(56) References Cited

U.S. PATENT DOCUMENTS 3,781,125 A 12/1973 Rahaim
4,017,213 A 4/1977 Przirembel
5,343,694 A 9/1994 Toborg
5,372,476 A * 12/1994 Hemmelgarn et al. ..... 415/135
7,771,164 B2 * 8/2010 Manteiga et al. ..... 415/209.3

OTHER PUBLICATIONS

U.S. Appl. No. 10/891,400, Ellis.

* cited by examiner

*Primary Examiner* — Michael Cuff
*Assistant Examiner* — Vikansha S Dwivedi
(74) *Attorney, Agent, or Firm* — Shook, Hardy & Bacon L.L.P.

(57) ABSTRACT

A turbine static structure having reduced leakage air is disclosed. A static structure turbine support ring having few segments is disclosed in which the segments have improved thermal expansion capability with reduced air leakage. A plurality of radially extending slots are placed in the segments to reduce stiffness. In order to minimize air leakage through the support ring, generally circumferential slots are placed in the ring and connect with the generally radially extending slots. Positioned in each of the generally radially extending slots and generally circumferential slots, and in contact with each other, are two sheet metal plates. The plates are staked to the support ring structure so as to provide a seal member, yet compensate for thermal growth.

17 Claims, 7 Drawing Sheets

TURBINE STATIC STRUCTURE FOR REDUCED LEAKAGE AIR

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present invention relates to gas turbines. More particularly, embodiments of the present invention relate to apparatus and method for reducing cooling air leakage through a turbine static structure.

BACKGROUND OF THE INVENTION

Gas turbine engines are known to operate in extreme environments exposing the engine components, especially those in the turbine section, to high operating temperatures as well as high thermal and mechanical stresses. As a result of such elevated operating conditions, components in the turbine are exposed to large temperature gradients. These temperature gradients can cause significant thermal growth in turbine components. As one skilled in the art will understand the amount of growth of an engine component is a function of the coefficient of thermal expansion for the material and the change in temperature across the component.

In order for the turbine components to endure these conditions, it is necessary to actively cool these components and/or allow for the components to grow or move. While active cooling, such as directing compressor discharge air through or across heated components, is an option, the more air taken from the compressor for cooling, the less efficient the engine, as less air is available for combustion and mechanical work. However, in order to allow for thermal growth among mating components, gaps or spaces are required there between, so as to not create elevated stresses when adjacent parts move and contact each other. Alternatively, allowances can be made for thermal growth by reducing the stiffness of components by increasing their flexibility or ability to move with temperature changes. However, often times this increase in flexibility requires smaller, yet a greater quantity of components, in order to be equivalent to a larger, single piece design.

An example of a gas turbine engine component subject to these conditions is found in the turbine section. More particularly, one feature, common in larger gas turbine engines, is a static structure known as a turbine support ring. As one skilled in the art will understand, this ring is typically positioned radially outward of a stage of stationary airfoils (vanes) and serves to hold the vanes in place. This ring can also hold a set of shroud blocks or outer air seals that are positioned radially outward of a stage of rotating airfoils (blades). Cooling air for the vanes or shroud blocks is typically directed through the support ring. This support ring can often be exposed to a temperature gradient of up to 250 degrees F.

Referring to FIG. 1, a portion of a prior art turbine support ring is shown. This ring was split into numerous sections 100 so as to allow for the thermal growth. In fact, depending on the size of the ring in question, there can be up to 48 sections. That means there are up to 48 gaps through which the air can leak if not properly sealed. Seals were placed in between sections

100 in an attempt to control the air leakage. However, these gaps still leaked. For example, for the first stage of turbine vanes in a land-based gas turbine engine, these gaps leaked approximately 2.2% of the total cooling air supplied to this stage of the turbine. The leakage of cooling air results in reduced cooling air effectiveness, thereby requiring more air to cool the components. As a result, that is less air to be directed through the combustor and turbine, thereby lowering efficiency of the turbine. In addition to the leakage issues, assembling a ring with numerous segments (up to 48) and corresponding seals is a tedious and time-consuming process.

SUMMARY OF THE INVENTION

The present invention provides embodiments for reducing the air leakage through a turbine static structure. In an embodiment of the present invention a turbine support ring having significantly fewer segments is disclosed in which the segments have improved thermal expansion capability while reducing air leakage. The reduction in cooling air leakage is accomplished by a generally circumferential slot connected with a generally radially extending slot and positioning two sheet metal plates in the slots and in contact with each other. The plates are staked to the support ring structure so as to provide a seal member, yet allow for thermal growth.

In an additional embodiment, a gas turbine engine is disclosed in which the engine includes one or more support ring structures proximate the turbine for supporting vane assemblies and shroud blocks. A support ring in accordance with this invention reduces the amount of leakage air passing there through by reducing the number of segments. A plurality of slots are provided in the larger ring segments to reduce stiffness of the segments. Each slot contains a seal member positioned to provide a seal against leakage of turbine cooling air.

In a further embodiment, a method of sealing a turbine support ring is disclosed. A turbine support ring is provided in accordance with the features described above. A generally radially extending plate is inserted into the radially extending slot of the support ring. A generally circumferentially extending plate is inserted into the generally circumferential slot until the generally circumferentially extending plate contacts the generally radially extending plate so as to form a seal. The generally radially extending plate is staked to the inner edge of the support ring and the generally circumferential plate is staked to either the forward wall or rear wall of the support ring, depending on which wall contains an opening to the generally circumferential slot.

In yet a further embodiment, an alternate method of sealing a turbine support ring is disclosed. In this method a generally radially extending plate having a height less than that of the radial slot is inserted completely into the slot of the support ring. A generally circumferentially extending plate is inserted into the generally circumferential slot so as to contain the radially extending plate. A seal is formed by the intersection of the two plates. The generally circumferentially extending plate is staked to either the forward wall or rear wall of the support ring so as to contain the generally radially extending plate.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

For clarity purposes, it is best to identify some of the common terminology that will be discussed in greater detail with respect to embodiments of the present invention. A "gas turbine engine," as the term is utilized herein, is an engine which provides mechanical output in the form of either thrust for propelling a vehicle or shaft power for driving an electrical generator. Gas turbine engines typically comprise a compressor, at least one combustor, and a turbine. A "turbine", as the term is utilized herein, is a series of alternating rows of stationary and rotating airfoils that increase in radial size such that as the airflow passes through the turbine, the airflow drives the rotating airfoils and the fluid expands. A "support ring" as the term is utilized herein is a static structure that is located generally circumferentially about the turbine and is used to support and locate, axially and radially, static hardware such as vane assemblies and shroud blocks within the turbine.

Figure 1:
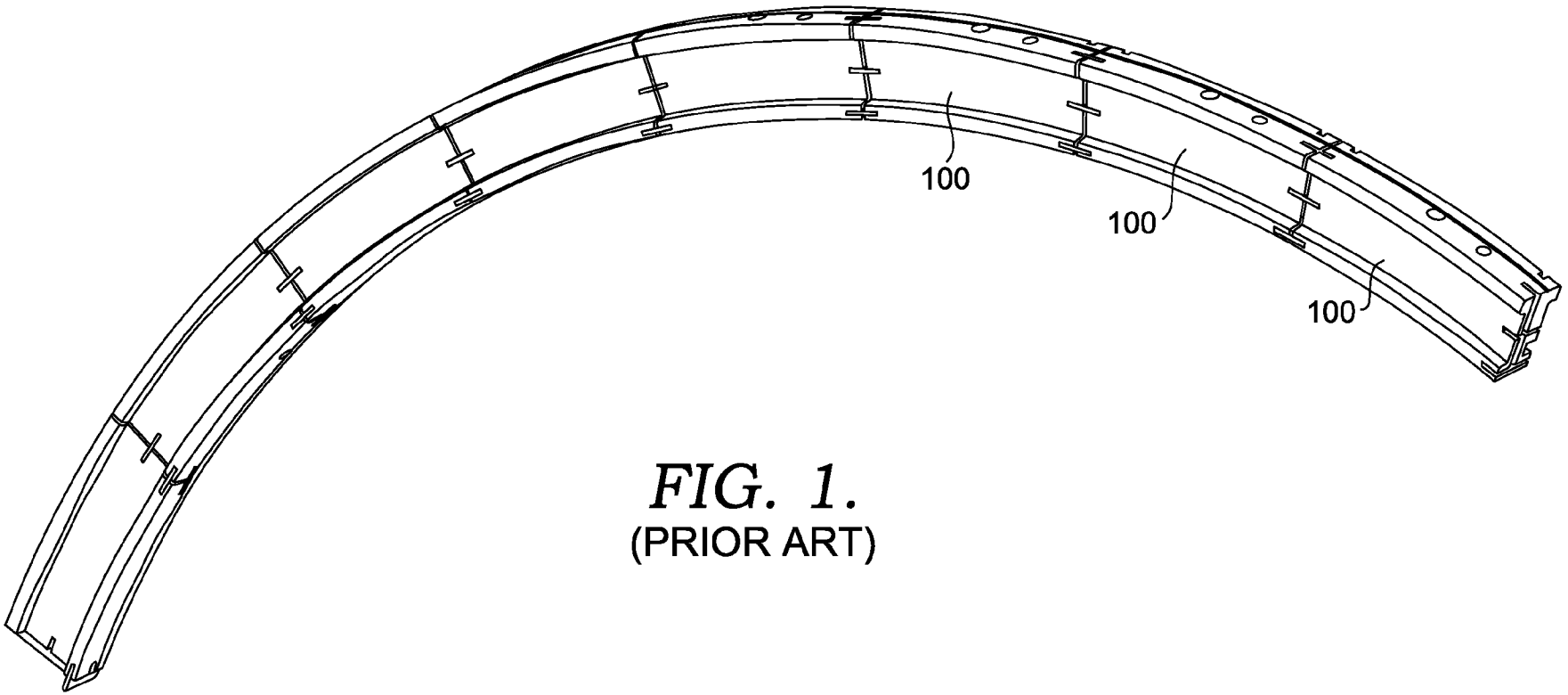
FIG. 1. (PRIOR ART)
FIG. 1 depicts a perspective view of a portion of a prior art gas turbine support ring.
Figure 2:
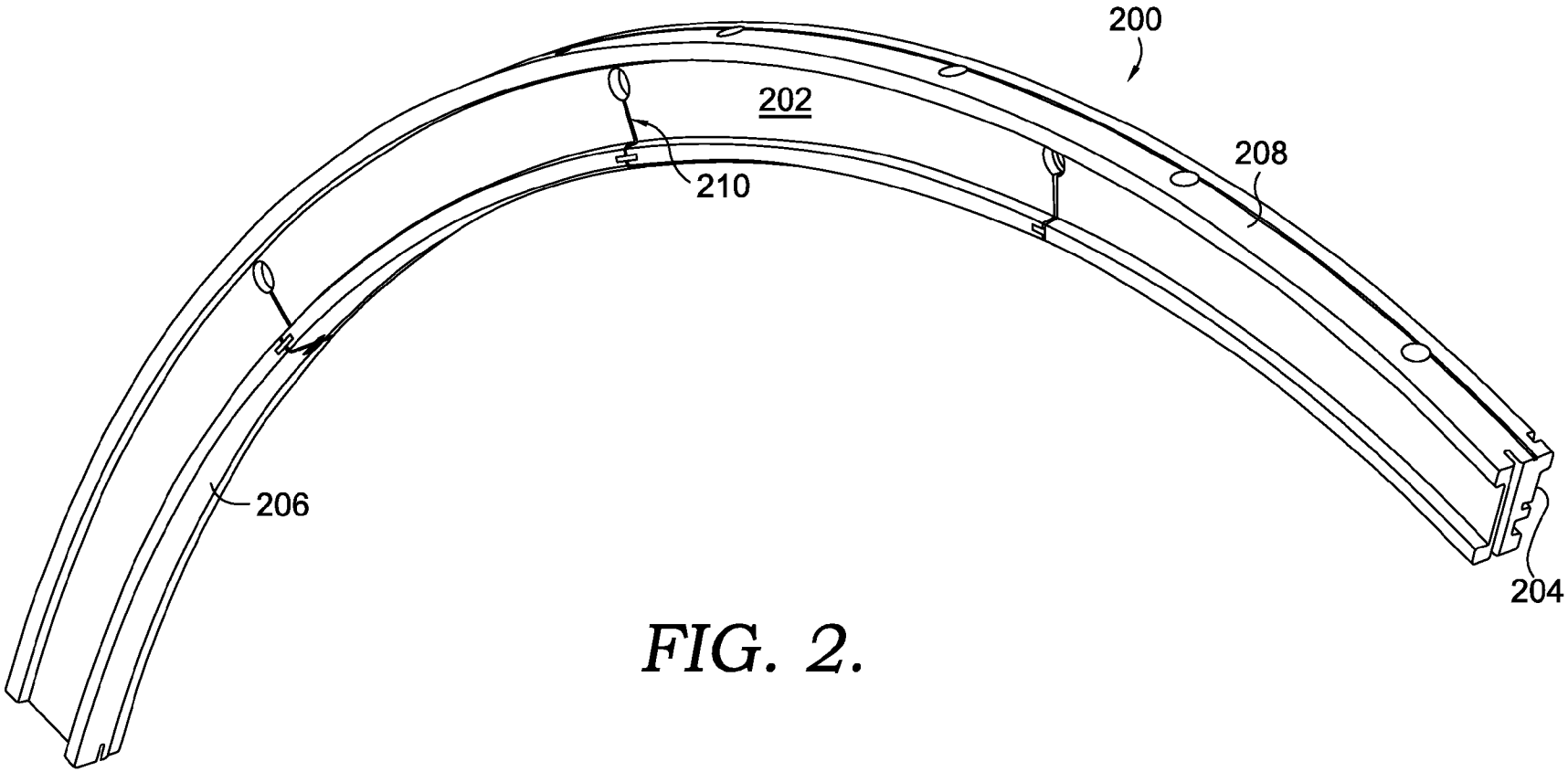
FIG. 2 depicts a perspective view of a portion of a turbine support ring in accordance with an embodiment of the present invention.

The present invention provides a turbine static structure having reduced air leakage. Embodiments of the present invention are described below with reference to FIGS. 2-7. Referring initially to FIG. 2, a portion of turbine support ring in accordance with an embodiment of the present invention is shown in perspective view. The support ring comprises a plurality of arc-shaped segments 200, that once assembled, form a ring that extends circumferentially about a portion of a turbine. As such, only one of the segments is shown in FIG. 2 for clarity purposes. For the embodiment shown in FIG. 2, the arc-shaped segment 200 is a 90 degree segment, with a total of four segments required to assemble the turbine support ring. Further details of arc-shaped segment 200 can be seen in FIGS. 3-5C.

Figure 3:
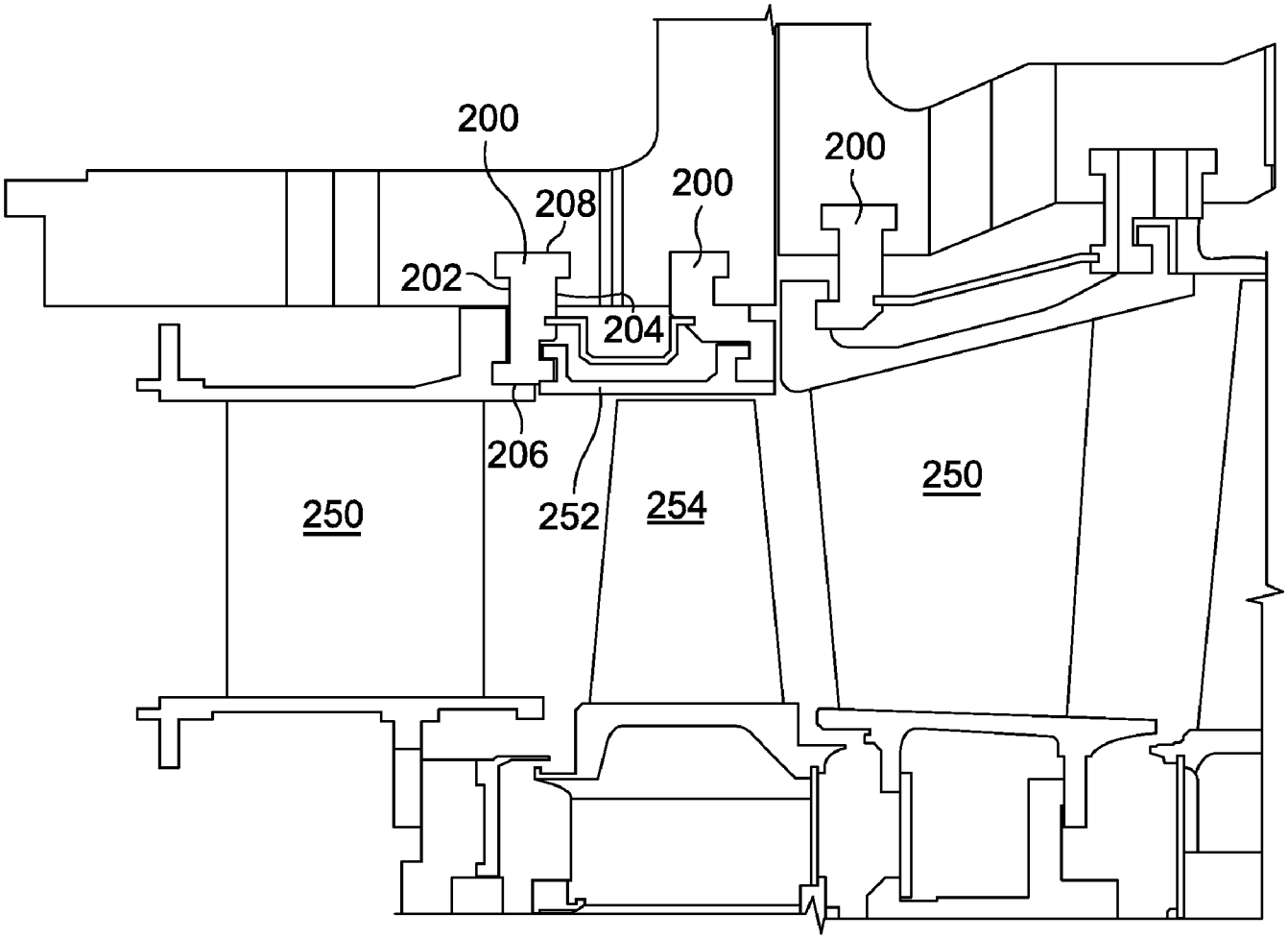
FIG. 3 depicts a cross section view of a portion of a turbine in accordance with an embodiment of the present invention.

Segment 200 has a forward wall 202 that is located on the upstream side of the segment and a rear wall 204 located downstream of the forward wall. Segment 200 also comprises an inner wall 206 and an outer wall 208, with outer wall 208 being radially outward of inner wall 206. The designations of forward and rear are given with respect to the axial positions of segment 200 within the confines of a gas turbine engine, as shown in FIG. 3. Also, the terms inner and outer are assigned based on the position of the segment 200 within the engine relative to an engine centerline.

Figure 4:
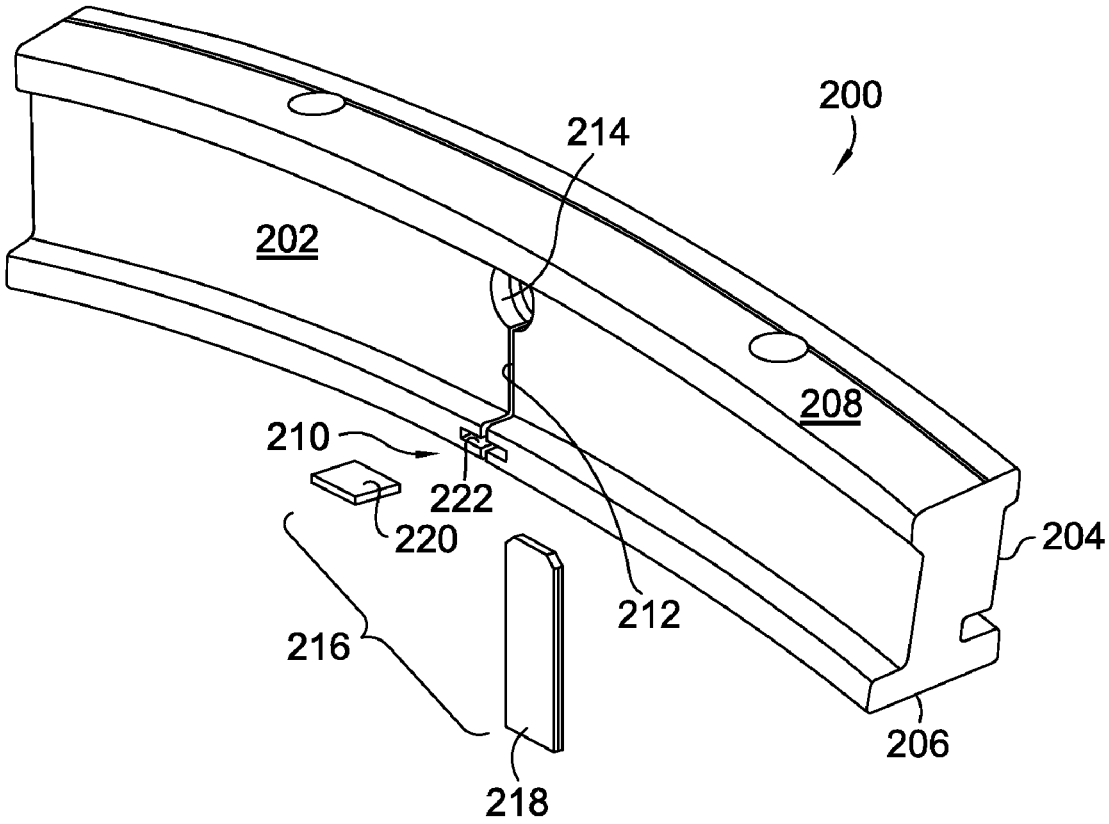
FIG. 4 depicts an exploded perspective view of a portion of a turbine support ring and a seal in accordance with an embodiment of the present invention.

Referring now to FIG. 4, a plurality of radially extending slots 210 are located within segment 200 and extend from the inner wall 206. The size and quantity of radially extending slots 210 depends on a variety of factors, including, but not limited to, diameter, arc-length, material, and operating temperatures of segments 200.

Another feature of radially extending slots 210 is the shape of the slot itself. For the arc-shaped segments 200 comprising the turbine support ring, it is preferred that that the radially extending slots 210 have a "keyhole" shape. The keyhole shape consists of a relatively thin radially extending opening 212 with a larger, rounded opening 214 at the end of the thin radially extending opening 212. Radially extending slots 210 provide a means that reduce the stiffness of arc-shaped segments 200 such that the arc-shaped segments can flex due to thermal growth. Providing the rounded opening 214 at the end of each radially extending opening 212 eliminates sharp corners that would have been found at the end of opening 212. The rounded opening 214 provides better stress distribution such that any stress concentrations are eliminated.

However, the radially extending slots 210, while providing a means to reduce the stiffness of arc-shaped segment 200, now permit air dedicated for cooling to leak through the slots 210, if left unsealed. To prevent the leakage of air through slots 210, a seal member 216 is utilized. In an embodiment of the invention, the seal member 216 comprises a generally radially extending plate 218 and a generally circumferentially extending plate 220. These plates, when utilized together, are positioned to provide a seal against leakage of turbine cooling air through the slots 210.

Figure 5A:
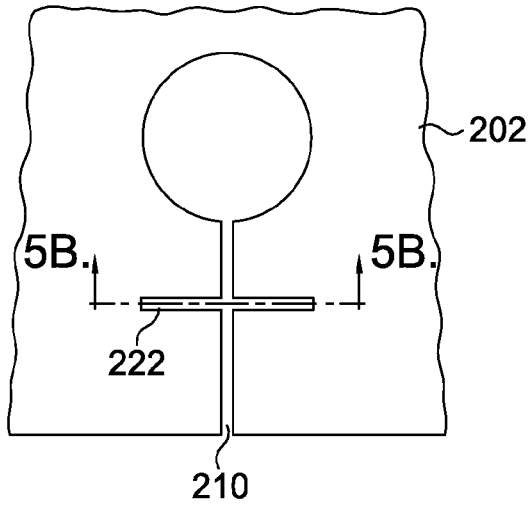
FIG. 5A depicts a detailed elevation view of a portion of a turbine support ring containing the keyhole slot in accordance with an embodiment of the present invention.
Figure 5B:
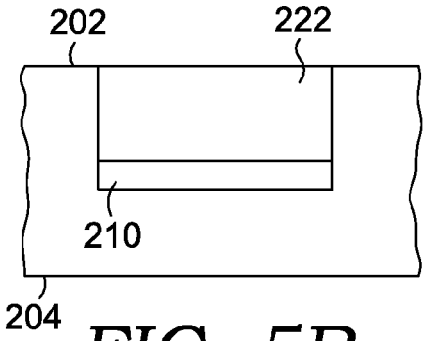
FIGS. 5B and 5C depict cross section views taken through FIG. 5A showing the unsealed and sealed slot configuration, respectively, in accordance with an embodiment of the present invention.
Figure 5C:
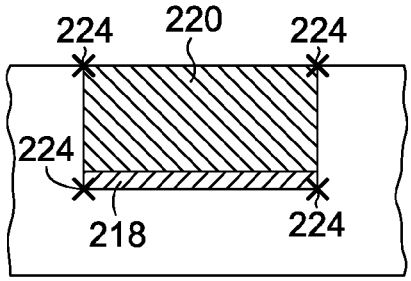
Figure 5D:
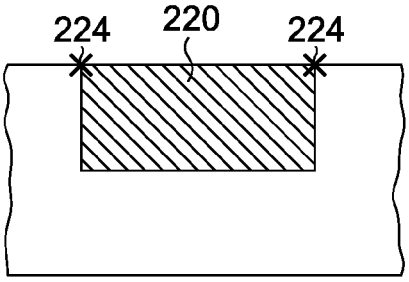
FIG. 5D depicts a cross section view taken through FIG. 5A showing the sealed slot configuration in accordance with an alternate embodiment of the present invention.
Figure 6:
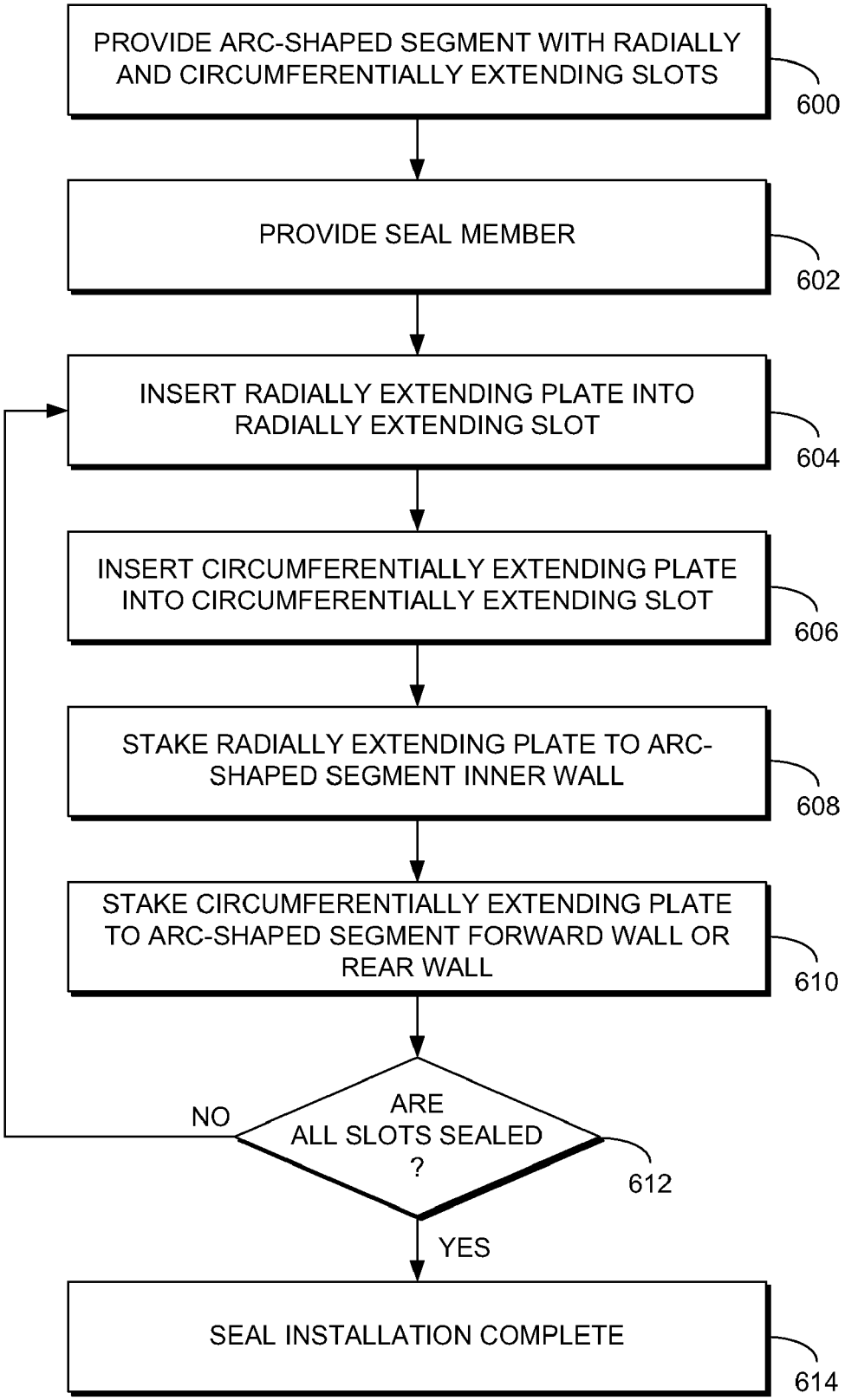
FIG. 6 depicts an illustrative method for sealing a turbine support ring in accordance with an embodiment of the present invention.

Referring now to FIGS. 4-5D, the generally radially extending plate 218 is positioned within the radially extending slot 210. However, due to manufacturing and assembly tolerances, the thickness of radially extending plate 218 is less than the opening thickness of the slot 210. As such, air can still leak along the sides of plate 218 when installed in the slot 210. To improve the integrity of the seal, as previously mentioned, a generally circumferentially extending plate is used. The circumferentially extending plate 220 is placed through a generally circumferential slot 222, which connects with the radially extending slot 210. The generally circumferential slot 222 is placed in either the forward wall 202 or the rear wall 204 and extends to the radially extending slot 210. The depth of the circumferential slot 222 is determined by the location of the radially extending slot 210. That is, the circumferential slot 222 depth stops at the intersection with radially extending slot 210, and does not extend completely from the forward wall 202 to the rear wall 204.

The generally radially extending plate 218 is positioned within the radially extending slot 210 and the generally circumferentially extending plate 220 is positioned within the generally circumferential slot 222. The generally circumferentially extending plate 220 is inserted into the generally circumferential slot 222 until it contacts the generally radially extending plate 218. Upon contact of these two plates, a more complete seal is formed where the circumferentially extending plate 220 has pushed the radially extending plate 218 to one side of the radially extending slot 210, which is opposite the circumferential slot 222. FIG. 5C depicts a cross section taken through the circumferential slot 222 with both plates installed in their respective slots.

In order to permit thermal growth and movement of the seal members relative to the slot 210, each of the plates 218 and 220 of the seal member 216 are staked (as indicated by 224) to the walls of the arc-shaped segment 200, and not welded or brazed. That is, the generally radially extending plate 218 is staked to the inner wall 206 and the generally circumferentially extending plate 220 is staked to either the forward wall 202 or the rear wall 204, depending from which wall the generally circumferential slot extends. As such, the seal member 216 has a general T-shape, depending on the radial location of the circumferential slot 222.

In an alternate embodiment, it is possible to position the generally circumferential slot closer to the inner wall 206 or adjacent the inner wall 206 such that the generally radially extending plate 218 and the generally horizontally extending plate 220 are fixed together or are a single part so as to have a general "L-shape."

In yet another embodiment of the present invention, a different arrangement of the generally radially extending plate 218 and generally circumferentially extending plate 220 is presented. This configuration is shown in the installed position in FIG. 5D. In this embodiment, the generally radially extending plate 218 is inserted entirely within the radial slot 210 such that when the generally circumferential plate 220 is inserted into the circumferential slot 222, the generally circumferential plate 220 contains the generally radially extending plate 218 with the slot 210 and prevents generally radially extending plate 218 from sliding out of the slot 210.

In an alternate embodiment, a gas turbine engine is disclosed which utilizes one or more support ring structures proximate the turbine. The gas turbine engine includes a compressor, a plurality of combustors, and a turbine. The turbine is coupled to the compressor through a shaft along the engine centerline (not shown). Cooling air for the turbine is taken from the compressor section. Referring again to FIG. 3, the support ring(s) are positioned circumferentially about the turbine for the purposes of positioning and supporting the vane assemblies 250 and shroud blocks 252 that encompass the blades 254. The support ring(s) include the features previously identified with respect to the arc-shaped segments having a plurality of generally radially and generally circumferentially extending slots incorporating generally radial and generally circumferential seal plates.

Cooling air is directed into the support rings and then into either the vane, or shroud block depending on the stage of the turbine. The amount of air leaking out of the support ring is reduced significantly by having few segments and providing a seal member for the plurality of slots incorporated to reduce stiffness of the larger segments. In fact, for the embodiment described herein, cooling air leakage is reduced by approximately 50% compared to the prior art support ring design.

In a further embodiment, a method of sealing a turbine support ring is disclosed. This method incorporates the components described above in that in a step 600 at least one arc-shaped segment having a forward wall, a rear wall, an inner wall, and an outer wall is provided with a plurality of radially extending slots extending from the inner wall and a plurality of generally circumferentially slots connecting with the radial slots. The circumferential slots extend from either the forward wall or the rear wall to the radial extending slot. In a step 602, a seal member comprising a generally radially extending plate and a generally circumferentially extending plate is provided. In a step 604, the generally radially extending plate is inserted into the radially extending slot. Next, in a step 606, the generally circumferentially extending plate is inserted into a circumferential slot until the generally circumferentially extending plate contacts the generally radially extending plate. This ensures that a seal is made. In a step 608, the generally radially extending plate is staked to the inner wall of the arc-shaped segment to prevent the plate from becoming dislodged. In a step 610, the generally circumferentially extending plate is staked to either the forward wall or rear wall, depending on from which wall the circumferential slot extends. In a step 612, a determination is made as to whether or not all slots have been sealed. If all slots have been sealed, then the seal installation is complete (step 614) and the arc-shaped segment is ready to be assembled with other segments, or have the vane assemblies or shroud blocks assembled thereto. If there are slots that are still to be sealed, then a technician would return to step 604 and repeat the process of inserting and staking the seal plates until all slots are sealed.

Figure 7:
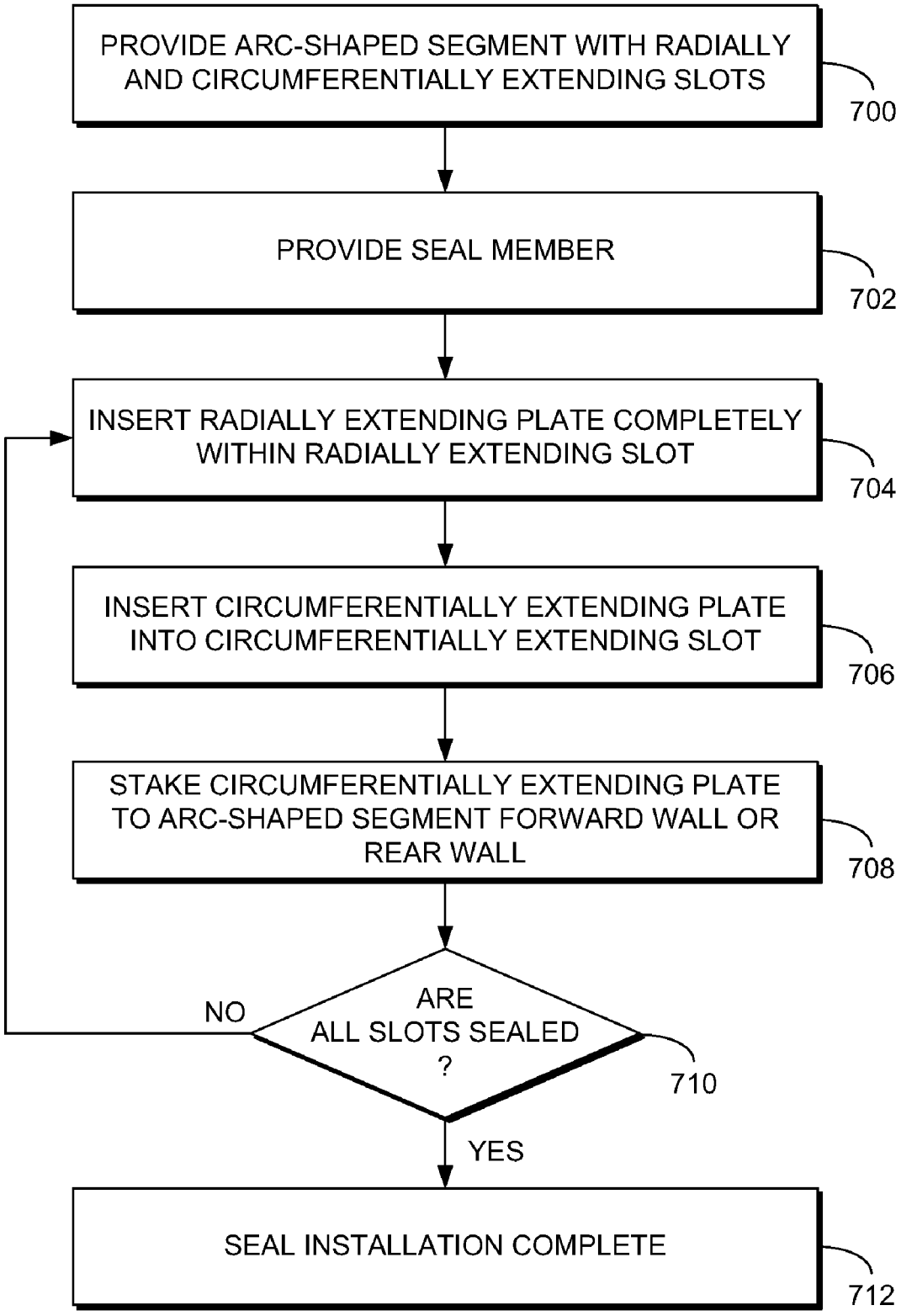
FIG. 7 depicts an alternate illustrative method for sealing a turbine ring in accordance with an embodiment of the present invention.

In yet a further embodiment of the present invention, an alternate method of sealing a turbine ring is disclosed and described in FIG. 7. This method also incorporates the components described above in that in a step 700 at least one arc-shaped segment having a forward wall, a rear wall, an inner wall, and an outer wall is provided with a plurality of radially extending slots extending from the inner wall and a plurality of generally circumferentially slots connecting with the radial slots. The circumferential slots extend from either the forward wall or the rear wall to the radial extending slot. In a step 702, a seal member comprising a generally radially extending plate and a generally circumferentially extending plate are provided. The generally radially extending plate has a height that is less than that of the radially extending slot. In a step 704, the generally radially extending plate is inserted completely into the radially extending slot. Next, in a step 706, the generally circumferentially extending plate is inserted into a circumferential slot until the generally circumferentially extending plate contacts the turbine support ring thereby trapping the generally radially extending plate into the radial slot. In a step 708, the generally circumferentially extending plate is staked to either the forward wall or rear wall, depending on from which wall the circumferential slot extends. In a step 710, a determination is made as to whether or not all slots have been sealed. If all slots have been sealed, then the seal installation is complete (step 712) and the arc-shaped segment is ready to be assembled with other segments, or have the vane assemblies or shroud blocks assembled thereto. If there are slots that are still to be sealed, then a technician would return to step 704 and repeat the process of inserting and staking the seal plates until all slots are sealed.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A circumferentially-extending support ring positioned about a turbine for supporting a plurality of turbine vane assemblies extending radially inward from the support ring comprising:

a plurality of arc-shaped segments having a forward wall, a rear wall, an inner wall, and an outer wall, wherein the outer wall is radially outward of the inner wall and the forward wall is configured to receive a vane rail;

a plurality of radially extending slots in the arc-shaped segments, the slots extending radially outward from the inner wall;

a plurality of generally circumferential slots, each connecting to the plurality of radially extending slots; and, a seal member comprising a generally radially extending plate and a generally circumferentially extending plate wherein the plates are positioned so as to provide a seal against leakage of turbine cooling air through the slots.

2. The turbine support ring of claim 1 wherein the plurality of arc-shaped segments comprise four 90 degree segments.

3. The turbine support ring of claim 1 wherein the plurality of radially extending slots are keyhole-shaped.

4. The turbine support ring of claim 1 wherein the generally circumferential slots extend from one of the forward wall or the rear wall to the radially extending slots.

5. The turbine support ring of claim 1 wherein the generally radially extending plate is positioned within the radially extending slot.

6. The turbine support ring of claim 5 wherein the generally radially extending plate is staked to the inner wall of the arc-shaped segment.

7. The turbine support ring of claim 1 wherein the generally circumferentially extending plate is positioned within the generally circumferential slots.

8. The turbine support ring of claim 7 wherein the generally circumferentially extending plate is staked to one of the forward wall or the rear wall.

9. The turbine support ring of claim 1 wherein the seal member has a generally L-shape such that the generally radially extending plate is fixed to the generally circumferentially extending plate.

10. A gas turbine engine comprising:

a compressor;

a plurality of combustors;

a turbine coupled to the compressor through a shaft along an engine centerline, the turbine having alternating rows of stationary and rotating airfoils, and at least one support ring positioned generally about the turbine for supporting a row of stationary airfoils extending radially inward towards the engine centerline, the support ring comprising:

a plurality of arc-shaped segments having an inner wall and an outer wall, wherein the outer wall is radially outward of the inner wall, a forward wall, and a rear wall;

a plurality of radially extending slots in said arc-shaped segments, the slots extending radially outward from the inner wall;

a plurality of generally circumferential slots, each of which are connected to a plurality of radially extending slots; and a seal member comprising a generally radially extending plate and a generally circumferentially extending plate wherein the plates are positioned so as to provide a seal against leakage of turbine cooling air through the slots.

11. The gas turbine engine of claim 10 wherein the plurality of arc-shaped segments comprises four 90 degree segments.

12. The gas turbine engine of claim 10 wherein the support ring is positioned generally circumferentially about a row of stationary airfoils.

13. The gas turbine engine of claim 10 wherein the support ring is positioned generally circumferentially about a row of rotating airfoils.

14. The gas turbine engine of claim 10 wherein the plurality of radially extending slots in the support ring are keyhole-shaped.

15. The turbine support ring of claim 10 wherein the generally radially extending plate is positioned within the radially extending slot and is staked to the inner wall of the arc-shaped segment.

16. The turbine support ring of claim 15 wherein the generally circumferentially extending plate is positioned within the generally circumferential slot and is staked to one of the forward wall or the rear wall.

17. The turbine support ring of claim 16 wherein the generally circumferentially extending plate contacts the generally vertically extending plate.

* * * * *